US008736655B2

(12) United States Patent
Lee

(10) Patent No.: US 8,736,655 B2
(45) Date of Patent: May 27, 2014

(54) LIGHT SCANNING UNIT AND ELECTROPHOTOGRAPHIC IMAGE FORMING APPARATUS USING THE SAME

(75) Inventor: Jong-Min Lee, Suwon-Si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 350 days.

(21) Appl. No.: 12/729,627

(22) Filed: Mar. 23, 2010

(65) Prior Publication Data

US 2011/0025811 A1 Feb. 3, 2011

(30) Foreign Application Priority Data

Jul. 30, 2009 (KR) ..... 10-2009-0069965

(51) Int. Cl.
*B41J 2/435* (2006.01)
*B41J 2/47* (2006.01)
*B41J 27/00* (2006.01)

(52) U.S. Cl.
USPC ..... 347/250; 347/235; 347/259; 347/260

(58) Field of Classification Search
USPC ..... 347/235, 250, 241, 256, 261, 259, 260; 250/206.1; 356/218; 359/216.1
See application file for complete search history.

(56) References Cited

U.S. PATENT DOCUMENTS 4,788,560 A * 11/1988 Miura ..... 347/236
6,094,406 A * 7/2000 Matsui ..... 369/53.28
7,450,287 B2 * 11/2008 Yoo et al. ..... 359/216.1
2006/0045149 A1 3/2006 Kasai
2008/0151036 A1 * 6/2008 Iwai ..... 347/260
2008/0225321 A1 * 9/2008 Choi ..... 358/1.13
2009/0147336 A1 6/2009 Suzuki et al.
2009/0168132 A1 7/2009 Miyatake

FOREIGN PATENT DOCUMENTS

CN 10-1054690 10/2007
CN 10-1683948 3/2010
JP 04-251814 9/1992

OTHER PUBLICATIONS

Chinese Office Action dated Jan. 16, 2014 issued in CN Application No. 201010163596.9.

* cited by examiner

*Primary Examiner* — Sarah Al Hashimi
(74) *Attorney, Agent, or Firm* — Stanzione & Kim, LLP

(57) ABSTRACT

Disclosed are a light scanning unit and an electrophotographic image forming apparatus including the light scanning unit. The light scanning unit may include a light source emitting a light beam, a beam deflector that deflects and scans the light beam emitted from the light source in a main scanning direction, a scanning optical system forming an image of a first portion of the light beam that is deflected and scanned by the beam deflector on a scanning surface and a beam detection sensor receiving a second portion of the light beam that is deflected and scanned by the beam deflector for generating a synchronization signal. The beam detection sensor may include a light receiving surface for receiving the second portion of the light beam, and at least two output terminals that are arranged outside an area of the light receiving surface within which the incident second portion of the light beam is confined.

14 Claims, 6 Drawing Sheets

LIGHT SCANNING UNIT AND ELECTROPHOTOGRAPHIC IMAGE FORMING APPARATUS USING THE SAME

CROSS-REFERENCE TO RELATED PATENT APPLICATION

This application claims the benefit of Korean Patent Application No. 10-2009-0069965, filed on Jul. 30, 2009, in the Korean Intellectual Property Office, the disclosure of which is incorporated herein by reference in its entirety.

TECHNICAL FIELD

The present disclosure relates generally to a light scanning unit and an electrophotographic image forming apparatus including the same, and, more particularly, to a light scanning unit of improved structure for detecting the horizontal synchronization signal and an electrophotographic image forming apparatus including the same.

BACKGROUND OF RELATED ART

A light scanning unit scans light emitted from a light source over an area, and is in wide usage, for example, in electrophotographic image forming apparatuses and in scan display devices.

In an image forming apparatus, the scanned light is utilized in the image formation, and thus determining the starting and ending positions of the light scanning is important for the proper formation of the image. A light scanning unit thus generally includes a synchronization signal detection unit for adjusting the horizontal synchronization of the image.

For example, in an electrophotographic image forming apparatus, the light scanning unit scans a light beam onto select portions of a uniformly charged surface of a photosensitive drum to thereby form an electrostatic latent image as the resulting potential difference, which is later developed using a developing agent such as, for example, toner, into a visible image. So developed visible image is then transferred onto a printing medium. If the scanning position of the light beam between scanning lines on the photosensitive drum of the above described image forming apparatus were to shift or vary, corresponding shifting in the image lines results; and, particularly when forming a color image, misalignments between the overlapping of the individual color images may occur, in turn resulting in blurred color image that may appear out of focus. The synchronization signal detection unit of the light scanning unit detects a portion of the scanned light beam in order to determine the proper scanning position of the scanned light beam. It is thus desirable to reduce the noise in the synchronization signal detection unit, particularly when forming a high resolution image.

SUMMARY OF DISCLOSURE

Aspects of the disclosure provides a light scanning unit having a light detection sensor with an improved refraction/diffusion noise characteristics and an electrophotographic image forming apparatus including such light scanning unit.

According to an aspect of the present disclosure, there may be provided a light scanning unit that may include a light source configured to emit a light beam, a beam deflector, a scanning optical system and a beam detection sensor. The beam deflector may be configured to deflect and to scan the light beam emitted from the light source along a main scanning direction. The scanning optical system may be configured to receive a first portion of the light beam that is deflected and scanned by the beam deflector and to form an image on a scanning surface with the receive first portion of the light beam. The beam detection sensor may be configured to receive a second portion of the light beam that is deflected and scanned by the beam deflector to generate a synchronization signal based on the received second portion of the light beam. The beam detection sensor may include a light receiving surface upon which the second portion of the light beam is incident and at least two output terminals that are arranged outside a scanning path of the second portion of the light beam on the light receiving surface.

The at least two output terminals may be spaced apart from each other by a predetermined distance on the light receiving surface. The scanning path of the second portion of the light beam may be between the at least two output terminals.

The at least two output terminals may be point-symmetrically arranged around the center of the light receiving surface.

The at least two output terminals may be spaced apart from each other in a direction perpendicular to the main scanning direction by a distance that is greater than a diameter of a beam spot of the second portion of the light beam that is formed on the light receiving surface.

The distance between the at least two output terminals may be at least 3.0 mm.

A rectangular opening portion having a lengthwise direction that is perpendicular to the scanning path of the second portion of the light beam may be formed in the light receiving surface of the beam detection sensor. The rectangular opening portion may be disposed between the at least two output terminals.

The beam detection sensor may be a pin photodiode. The at least two output terminals may be a cathode terminal and an anode terminal, respectively.

The light scanning unit may further comprise at least one of a beam detection lens and a beam detection mirror. The beam detection lens may be disposed between the beam deflector and the beam detection sensor, and may be configured to focus the second portion of the light beam on the light receiving surface of the beam detection sensor. The beam detection mirror may be arranged and configured to change the direction of the optical path of the second portion of the light beam toward the beam detection sensor.

According to another aspect of the present disclosure, an electrophotographic image forming apparatus may be provided to include a photosensitive body, a light scanning unit and a developing unit. The light scanning unit may be configured to scan light onto a scanning surface of the photosensitive body to form thereon an electrostatic latent image. The developing unit may be configured to supply toner to the electrostatic latent image formed on the photosensitive body to develop the electrostatic latent image into a visible toner image. The light scanning unit may comprise a light source configured to emit a light beam, a beam deflector, a scanning optical system and a beam detection sensor. The beam deflector may be configured to deflect and to scan the light beam emitted from the light source along a main scanning direction. The scanning optical system may be configured to receive a first portion of the light beam that is deflected and scanned by the beam deflector, and may be configured to form an image on a scanning surface with the receive first portion of the light beam. The beam detection sensor may be configured to receive a second portion of the light beam that is deflected and scanned by the beam deflector to generate a synchronization signal based on the received second portion of the light beam. The beam detection sensor may include a light receiving surface upon which the second portion of the light beam is incident and at least two output terminals that are arranged outside a scanning path of the second portion of the light beam on the light receiving surface.

The at least two output terminals may be spaced apart from each other by a predetermined distance on the light receiving surface. The scanning path of the second portion of the light beam may be between the at least two output terminals.

The at least two output terminals may be point-symmetrically arranged around a center of the light receiving surface.

The at least two output terminals may be spaced apart from each other in a direction perpendicular to the main scanning direction by a distance that is greater than a diameter of a beam spot of the second portion of the light beam that is formed on the light receiving surface.

The distance between the at least two output terminals may be at least 3.0 mm.

A rectangular opening portion having a lengthwise direction that is perpendicular to the scanning path of the second portion of the light beam may be formed in the light receiving surface of the beam detection sensor. The rectangular opening portion may be disposed between the at least two output terminals.

The beam detection sensor may be a pin photodiode. The at least two output terminals may be a cathode terminal and an anode terminal, respectively.

The electrophotographic image forming apparatus may further comprise at least one of a beam detection lens and a beam detection mirror. The beam detection lens may be disposed between the beam deflector and the beam detection sensor, and may be configured to focus the second portion of the light beam on the light receiving surface of the beam detection sensor. The beam detection mirror may be arranged and configured to change the direction of the optical path of the second portion of the light beam toward the beam detection sensor.

According to yet another aspect of the present disclosure, a light sensor may be provided for detecting whether a light beam produced by a light source and being scanned along a scanning direction across an object surface to be scanned with the light beam is at a position of interest in the scanning direction. The light sensor may comprise a sensor surface and two electrical terminals. Light produced by the light source may be incident upon the sensor surface that may include a light incident surface area within which the light incident upon the sensor surface is confined. The two electrical terminals may be arranged on the sensor surface outside the light incident surface area.

The light sensor may further comprise an opening formed on the sensor surface. The opening may have its length that extends perpendicular to the scanning direction, and the length may divide the sensor surface into first and second sides. The two electrical terminals may be arranged one on each of the first and second sides of the sensor surface.

The light incident surface area may be larger than a diameter of a beam spot formed by the light incident upon the sensor surface.

The two electrical terminals may be spaced apart from each other with respect to a direction perpendicular to the scanning direction by a distance greater than a diameter of a beam spot formed by the light incident upon the sensor surface.

BRIEF DESCRIPTION OF THE DRAWINGS

Various features and advantages of the present disclosure will become more apparent by the detailed description of several embodiments thereof with reference to the attached drawings, in which.

DETAILED DESCRIPTION OF SEVERAL EMBODIMENTS

Figure 1:
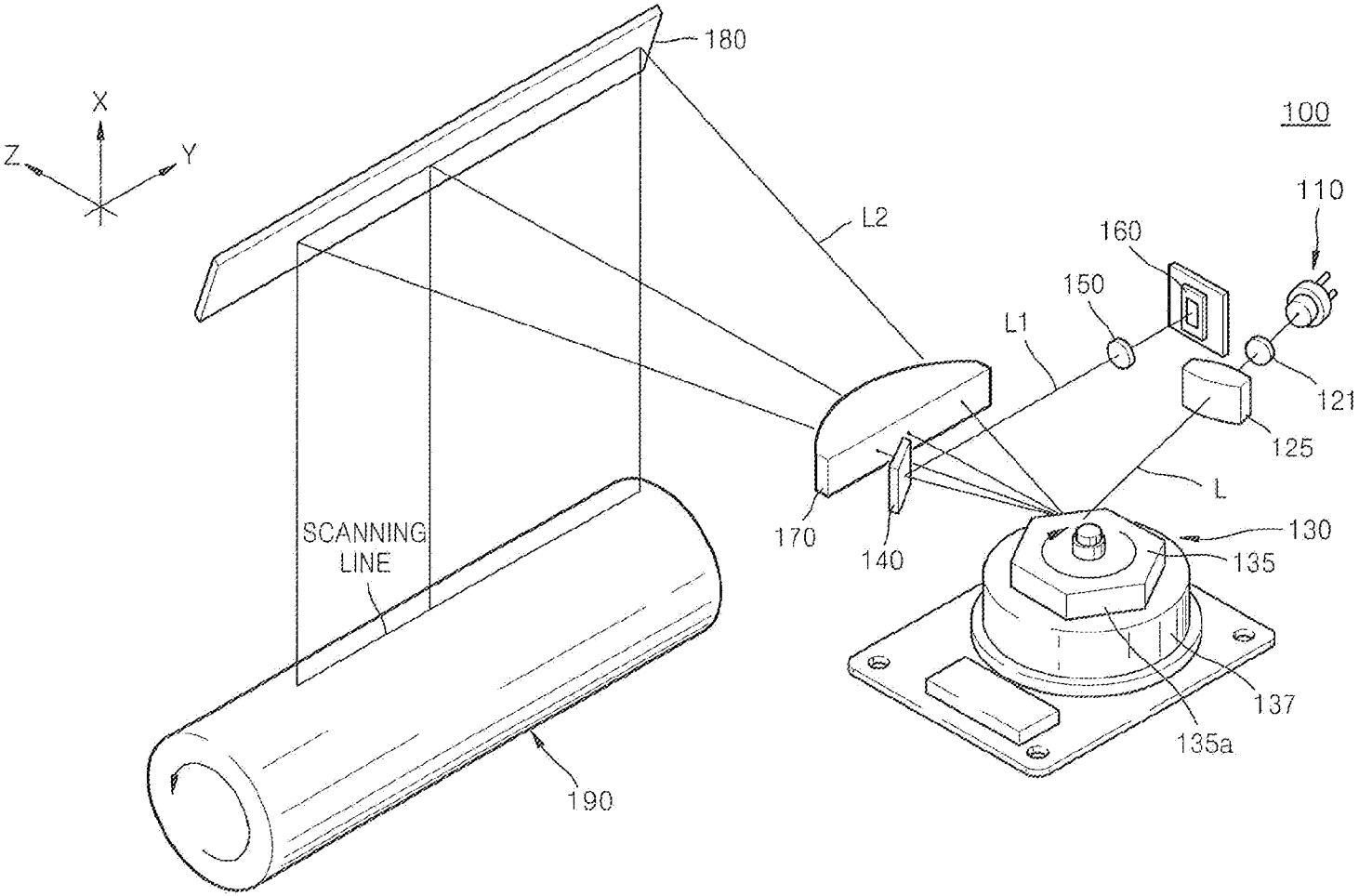
FIG. 1 is a perspective view illustrating an optical arrangement of a light scanning unit according to an embodiment of the present disclosure.

Aspects of the present disclosure will now be described more fully with reference to the accompanying drawings, in which several embodiments of the present disclosure are illustrated. In the accompanying drawings, like reference numerals refer to like elements throughout, repetitive descriptions of which may be omitted. It should be also noted that in the drawings, the dimensions of the features are not intended to be to true scale and may be exaggerated for the sake of allowing greater understanding. While several embodiments are described with particular details in order to allow a full and comprehensive understanding of the aspects of the present disclosure, and to fully enable those skilled in the art to practice the same, it should be understood, however, that many modifications and variations are possible to the embodiments shown and described herein, and that the full scope of the present disclosure should not be construed as being limited by those embodiments described herein.

Figure 2:
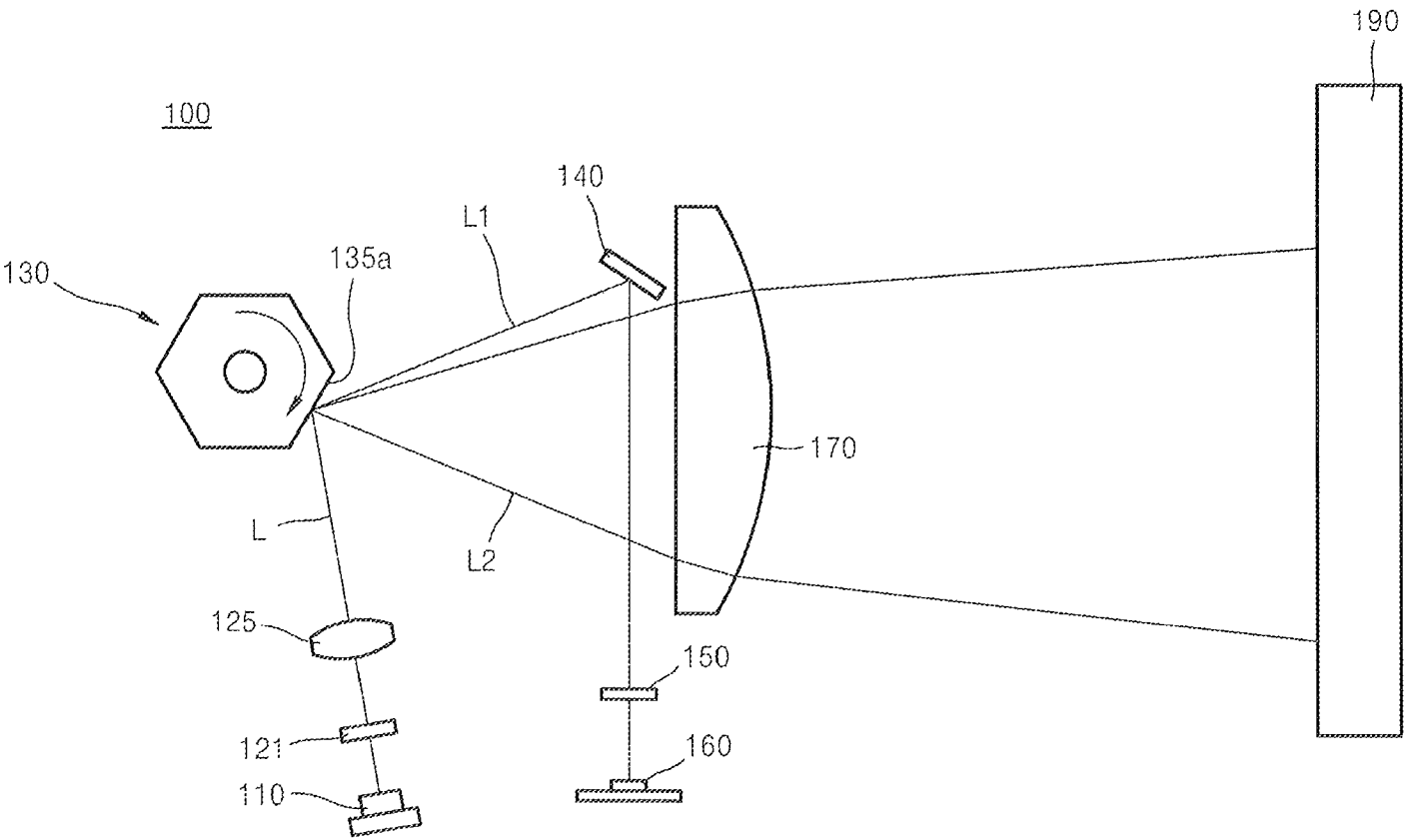
FIG. 2 is a schematic view of a light path in the light scanning unit illustrated in FIG. 1 in the sub-scanning direction.

FIG. 1 is a perspective view illustrating an optical arrangement of a light scanning unit 100 according to an embodiment of the present disclosure. FIG. 2 is a schematic view of a light path in the light scanning unit 100 illustrated in FIG. 1 in the sub-scanning direction. In FIG. 1, the Y-axis corresponds to the main scanning direction, which is parallel to a scanning line formed on a scanning surface of a photosensitive drum 190.

Referring to FIGS. 1 and 2, the light scanning unit 100 according to an embodiment may include a light source 110 emitting a light beam L, a beam deflector 130 deflecting and scanning the light beam L emitted from the light source 110 in the main scanning direction (Y-direction) onto the photosensitive drum 190, a scanning lens 170 that forms an image of the main light beam L2 that is deflected and scanned by the beam deflector 130 on the scanning surface of the photosensitive drum 190 and a beam detection sensor 160 that receives a portion of the light beam L deflected and scanned by the beam deflector 130, that is, the light beam L1, to generates a horizontal synchronization signal.

The light source 110 may be a laser diode. As illustrated in FIG. 1, the beam deflector 130 may include a polygon mirror 135 having a plurality of reflective surfaces 135*a* and a motor 137 rotating the polygon mirror 135. As the beam deflector 130 rotates, for example, in the clockwise direction as shown, the light beam L emitted from the light source 110 is deflected and scanned across the photosensitive drum 190 in the main scanning direction.

A first optical element 121 and a second optical element 125 may be disposed on a light path between the light source 110 and the beam deflector 130. The first optical element 121 may be, for example, a collimating lens that collimates the light beam L emitted from the light source 110. The second optical element 125 may focus the light beam L that has passed through the first optical element 121, with respect to the sub-scanning direction (X-direction) such that the cross section of the light beam L that is incident on the beam deflector 130 has a line shape. The sub-scanning direction (X-direction) is perpendicular to the main scanning direction (Y-direction), and may be parallel to the rotational axis of the beam deflector 130. The second optical element 125 may comprise at least one cylindrical lens. The positions of the first and second optical elements 121 and 125 may be exchanged. In addition, while depicted as a single optical element, any of the first and second optical elements 121 and 125 may alternatively comprise two or more optical elements.

The scanning lens 170 is an imaging optical element or elements that forms the main light beam L2 of the light beam L deflected and scanned by the beam deflector 130 into an image on the scanning surface of the photosensitive drum 190, and is disposed between the beam deflector 130 and the photosensitive drum 190. For example, the scanning lens 170 may be an fθ lens that focuses the main light beam L2 and corrects the same so as to scan the main light beam L2 onto the scanning surface of the photosensitive drum 190 at a uniform speed. While the scanning lens 170 illustrated in FIG. 2 as a single lens, in alternative embodiments, the scanning lens 170 may comprise two or more lenses. According to an embodiment, a reflection mirror 180 (omitted in FIG. 2) for adjusting the light path of the main light beam L2 may be further interposed between the scanning lens 170 and the photosensitive drum 190.

A beam detection mirror 140 may be disposed at a location in the light path of the light beam L1 that correspond to the starting point of a scanning line. The light beam L2 passes through the scanning lens 170 and proceeds to the photosensitive drum 190. In FIGS. 1 and 2, the beam detection mirror 140 is disposed between the beam deflector 130 and the scanning lens 170 such that the light beam L1 reflected by the beam detection mirror 140 is not incident on the scanning lens 170. However, according to alternative embodiments, the beam detection mirror 140 may be disposed between the scanning lens 170 and the photosensitive drum 190 such that the light beam L1 having passed through the scanning lens 170 may be incident on, and may be reflected by, the beam detection mirror 140.

Figure 3A:
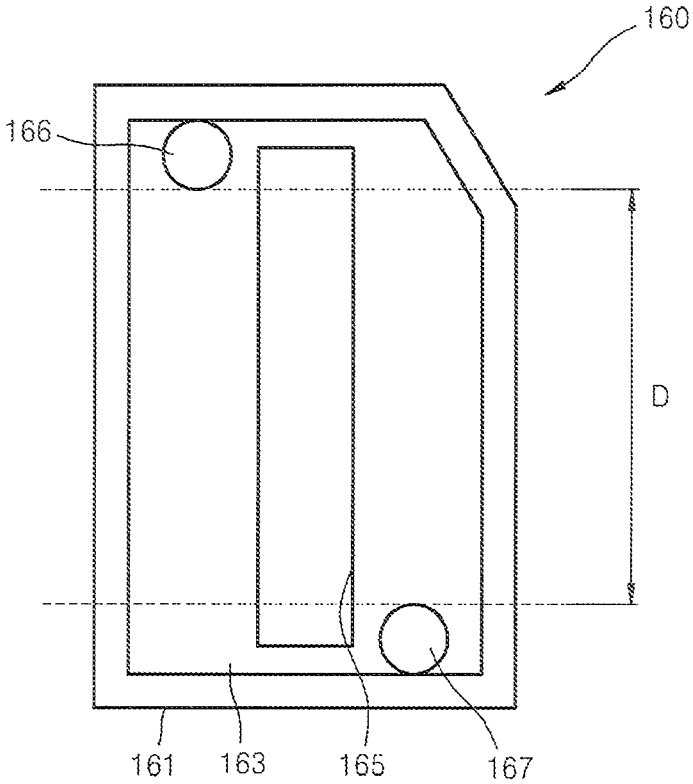
FIG. 3A is a plan view illustrating a beam detection sensor having a light receiving surface according to an embodiment of the present disclosure.

The beam detection sensor 160 detects the light beam L1 that is reflected by the beam detection mirror 140 and that has passed through a beam detection lens 150, thereby generating a horizontal synchronization signal. For example, the beam detection sensor 160 may be a pin photodiode. The pin photodiode may include an intrinsic semiconductor layer interposed between a P-region and an N-region, for example. The beam detection sensor 160 may include first and second output terminals 166 and 167 as illustrated in FIG. 3A, wherein the first and second output terminals 166 and 167 may respectively be an anode and a cathode. According to an embodiment, the pin photodiode including the two terminals 166 and 167 may be used as the beam detection sensor 160. However, other types of beam sensor can alternatively be used. For example, an avalanche photodiode, a hybrid type photodiode, or a phototransistor may alternatively be used as the beam detection sensor 160.

The horizontal synchronization signal generated by the beam detection sensor 160 may be converted into a digital signal, and may be output through an electronic circuit (not shown) so as to be used in controlling driving of the light scanning unit 100 and/or the photosensitive drum 190.

The beam detection lens 150 may be disposed between the beam detection mirror 140 and the beam detection sensor 160. The beam detection lens 150 may be a focusing lens that focuses the light beam L1 reflected by the beam detection mirror 140 onto the beam detection sensor 160.

Figure 3B:
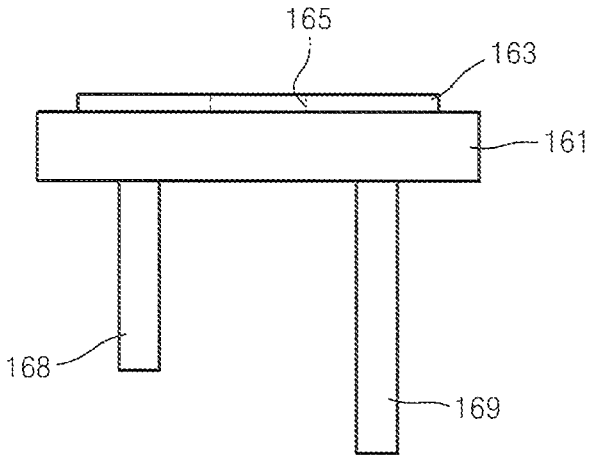
FIG. 3B is a side view illustrating the beam detection sensor of FIG. 3A.
Figure 4:
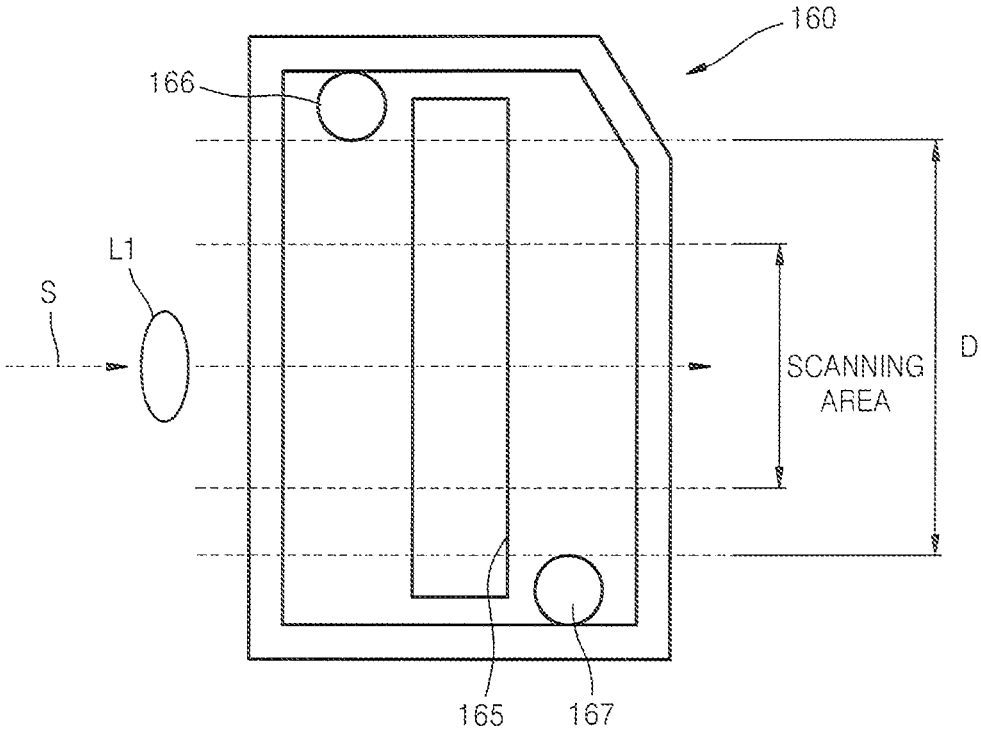
FIG. 4 is a schematic view illustrating an arrangement of a scanning light path of a light beam and output terminals of the beam detection sensor of FIG. 3A.

FIG. 3A is a plan view illustrating the beam detection sensor 160 according to an embodiment of the present disclosure. FIG. 3B is a side view illustrating the beam detection sensor 160 of FIG. 3A. FIG. 4 is a schematic view illustrating an arrangement of a scanning light path of the light beam L1 and the output terminals 166 and 167 of the beam detection sensor 160 of FIG. 3A.

Referring to FIGS. 3A and 3B, the beam detection sensor 160 may include a light receiving surface 163, onto which a light beam is incident, and the first and second output terminals 166 and 167, which output a horizontal synchronization signal that is generated by photoelectrically converting the light beam incident on the light receiving surface 163. The beam detection sensor 160 may be packaged using a mold 161, for example. A rectangular slit-shaped opening portion 165 may be formed in the light receiving surface 163. The beam detection sensor 160 may be arranged such that the lengthwise direction of the opening portion 165 is perpendicular to the main scanning direction. The opening portion 165 may restrict incident light beams in order to improve precision of the generated horizontal synchronization signal. The first and second output terminals 166 and 167 may be point-symmetrically arranged with respect to the center of the opening portion 165. The first and second output terminals 166 and 167 may be spaced apart from each other by a distance D with respect to the lengthwise direction of the opening portion 165 so as to remove noise that may be generated in the first and second output terminals 166 and 167, and as will be further described later in greater detail. Terminal pins 168 and 169 may be provided for the first and second output terminals 166 and 167, respectively, for electrical connections to the output terminals.

Referring to FIG. 4, the light beam L1 incident on the beam detection sensor 160 may be scanned across the light receiving surface 163. The scanning direction S of the light beam L1 corresponds to the main scanning direction. The scanning area on the light receiving surface 163 is where the beam spots of the light beam L1 may be formed. In consideration of the possible variations in the location of the beam spots of the light beam L1, according to an embodiment of the present disclosure, the scanning area has the dimension along a direction perpendicular to the main scanning direction of at least the size of the beam spot diameter. According to an embodiment of the present disclosure, the first and second output terminals 166 and 167 may be disposed outside the scanning area so that the light beam L1 is not directly incident on an area where the first and second output terminals 166 and 167 are arranged. Accordingly, the distance D between the first and second output terminals 166 and 167 with respect to the lengthwise direction of the opening portion 165 needs to be greater than at least the diameter of the beam spots of the light beam that are formed on the light receiving surface 163. For example, the diameter of beam spots of a light beam formed on the light receiving surface 163 may typically be 3 mm or less, and thus according to an embodiment the distance D between the first and second output terminals 166 and 167 with respect to the lengthwise direction may be at least 3 mm.

Figure 5:
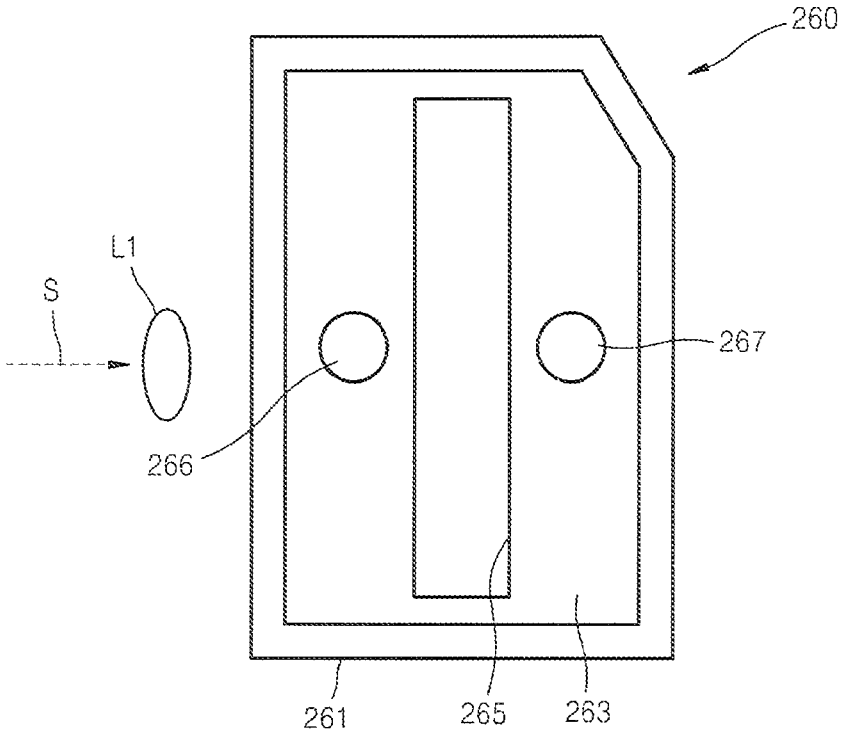
FIG. 5 is a plan view illustrating a beam detection sensor having a light receiving surface, according to a comparative example.

A comparative example of a beam detection sensor is illustrated in FIG. 5. Referring to FIG. 5, the beam detection sensor 260 may include a light receiving surface 263, onto which a light beam is incident, and the first and second output terminals 266 and 267 that output the horizontal synchronization signal that is generated by photoelectrically converting the light beam incident on the light receiving surface 263. The beam detection sensor 260 may be packaged using a mold 261. The first and second output terminals 266 and 267 may be arranged symmetrically about an opening portion 265 with respect to a lengthwise direction of the opening portion 265. It was observed that an abnormal horizontal synchronization signal may result with the beam detection sensor 260 of the comparative example. That is, the first and second output terminals 266 and 267 are arranged on an optical path of the light beam L1 in the scanning direction S where spots of the light beam L1 are formed in the beam detection sensor 260, and thus the light beam L1 may be refracted or diffused by the first and second output terminals 266 and 267. The refraction or diffusion of the light beam L1 by the first and second output terminals 266 and 267 acts as noise that results in an abnormality or inaccuracy in the horizontal synchronization signal, and consequently may also result in the inaccuracy in the converted digital signal. Such abnormal horizontal synchronization signal may cause a shift in one or more lines of the image, may generate a shadow over the image, or may even shift the entire image.

With the light scanning unit 100 of the configuration according to an embodiment of the present disclosure described above, however, the first and second output terminals 166 and 167 of the beam detection sensor 160 are disposed outside the scanning area of the light receiving surface 163, thus reducing the likelihood of an abnormal horizontal signal that may otherwise be generated due to the refraction or diffusion of the light beam L1 by the first and second output terminals 166 and 167. Furthermore, as the noise due to the above refraction/diffusion of the light beam L1 is sufficiently reduced, a testing for the presence of, and/or the measures to remove, such noise may become unnecessary, thus making it possible to realize a light scanning unit of a simpler construct and/or configuration.

The beam detection mirror 140, the beam detection lens 150, and the beam detection sensor 160 described above may constitute a synchronization detection optical system of the light scanning unit 100. According to an embodiment, in order to detect whether the light beam is positioned at the starting point where the main scanning of a scanning line of the light beam is to start, the beam detection mirror 140 is disposed at one end of the scanning line, that is, at the starting end of the scanning line. However, alternative arrangements are possible. For example, in a synchronization detection optical system according to another embodiment, in order to detect whether the light beam positioned at the end point of a scanning line of the light beam, a beam detection mirror (i.e., of a synchronization detection optical system) may be disposed at the other end of the scanning line. According to yet another alternative embodiment, a synchronization detection optical system may be disposed at each of the starting and ending ends of the scanning line, in order to detect whether the light beam is at the starting point of a scanning line and whether it is at the finishing point of the scanning line.

Figure 6:
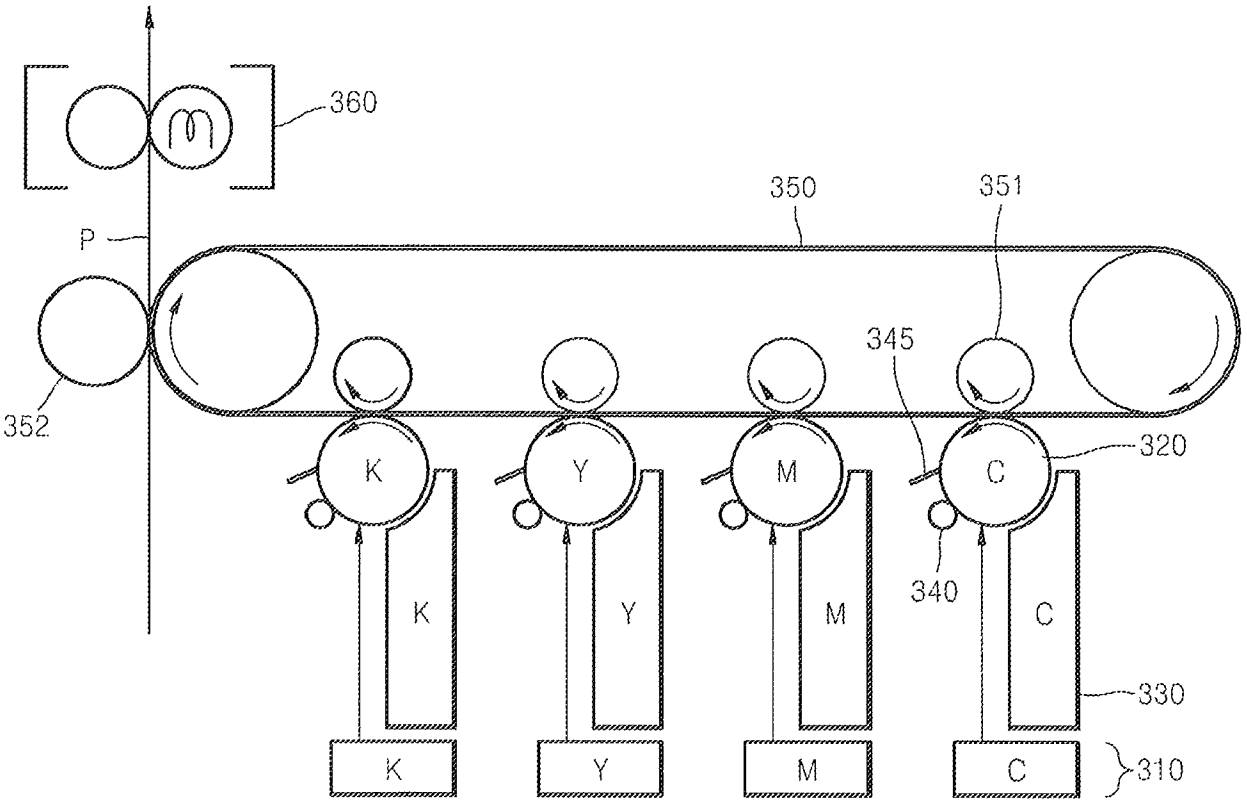
FIG. 6 is a structural diagram of an electrophotographic image forming apparatus including a light scanning unit according to an embodiment of the present disclosure.

FIG. 6 is a structural diagram of an electrophotographic image forming apparatus including a light scanning unit according to an embodiment of the present disclosure.

Referring to FIG. 6, the electrophotographic image forming apparatus according to an embodiment may include a light scanning unit 310, a photosensitive drum 320, a developing unit 330, a charging roller 340, a transfer belt 350, a first transfer roll 351, a second transfer roller 352 and a fixing unit 360.

As shown in FIG. 6, in order to form a color image, the light scanning unit 310, the photosensitive drum 320, the charging roller 340 and the developing unit 330 may be provided for each color developer being utilized for the color image formation. The light scanning unit 100 previously described may be used as the light scanning unit 310 provided for each color. For example, as shown in FIG. 6, four light scanning units 310 may scan light beams onto respective ones of the four of the photosensitive drums 320.

A photosensitive drum 320 is an example of a photosensitive body, and may include a layer of photosensitive material of a predetermined thickness coated on a circumferential surface of a cylinder metal pipe. Although not illustrated in FIG. 6, a photosensitive belt may be used as the photosensitive body. A circumferential outer surface of the photosensitive drum 320 corresponds to a scanning surface. The charging roller 340 is an example of a charging device, and may rotate in contact with the photosensitive drums 320 to charge the surface of the photosensitive drum 320 to a uniform potential. To that end, a charging bias may be applied to the charging roller 340. Alternatively, a corona charger (not shown) may be used instead of the charging roller 340. Each of the light scanning units 310 scans a light beam, which is modulated according to image information, in the main scanning direction to form an electrostatic latent image on the scanning surface of the photosensitive drums 320 that had been uniformly charged as previously described. As the scanning surface moves along a sub-scanning direction due to the rotation of the photosensitive drum 320, scanning of the light beam onto the scanning surface along the main scanning direction by the light scanning unit 310 is synchronized with the horizontal synchronization signal, thereby forming a two-dimensional electrostatic latent image on the scanning surface of the photosensitive drum 320.

Electrostatic latent images corresponding to the image information of black (K), magenta (M), yellow (Y), and cyan (C) are formed respectively on the four photosensitive drums 320. The four developing units 330 respectively supply the black (K), magenta (M), yellow (Y) and cyan (C) toners to the four photosensitive drums 320 to form the toner images of black (K), magenta (M), yellow (Y) and cyan (C) colors, respectively. The transfer belt 350 travels in contact with the four photosensitive drums 320 so that the individual toner images of black (K), magenta (M), yellow (Y) and cyan (C) colors are transferred onto the transfer belt 350 overlapping one another to form in combination a full color image by a first transfer bias applied to the four transfer rollers 351. Then, the full color toner image is transferred from the transfer belt 350 onto a recording medium P by a second transfer bias applied to the second transfer roller 352. The toner image transferred to the recording medium P is fixed thereto with heat and/or pressure supplied by the fixing unit 360, thereby completing the image forming process.

In the light scanning unit and the electrophotographic image forming apparatus according to the above-described embodiments of the present disclosure, the output terminals of the beam detection sensor are disposed outside the scanning path of the light beam incident on a light receiving surface of the beam detection sensor so as to reduce noise in the synchronization signal that may result from refraction or diffusion of the light beam. With the sufficient reduction in such noise, the testing for, and the removal of, such noise may become unnecessary, and thus may be omitted to realize a light scanning unit if a simpler configuration.

While the present disclosure has been particularly shown and described with reference to several embodiments thereof, it will be understood by those of ordinary skill in the art that various changes in form and details may be made to those embodiments described herein without departing from the spirit and scope of the present disclosure as defined by the following claims and their equivalents.

What is claimed is:

1. A light scanning unit, comprising:

a light source configured to emit a light beam;

a beam deflector configured to deflect and to scan the light beam emitted from the light source along a main scanning direction;

a scanning optical system configured to receive a first portion of the light beam that is deflected and scanned by the beam deflector to form an image on a scanning surface with the received first portion of the light beam;

a beam detection mirror disposed between the beam deflector and the scanning optical system, to change a direction of an optical path of a second portion of the light beam toward a beam detection sensor; and a beam detection sensor configured to receive the second portion of the light beam that is deflected and scanned by the beam deflector, without passing through the scanning optical system, to generate a synchronization signal based on the received second portion of the light beam, the synchronization signal being generated by photoelectrically converting the light beam incident on the light incident surface area and output via at least two output terminals, wherein the beam detection sensor includes a light receiving surface upon which the received second portion of the light beam is incident and the at least two output terminals that are arranged outside a scanning path of the received second portion of the light beam on the light receiving surface, and where the at least two output terminals are spaced apart from each other by a predetermined distance on the light receiving surface that is greater than the scanning path of the received second portion of the light beam between the at least two output terminals.

2. The light scanning unit of claim 1, wherein the at least two output terminals are point-symmetrically arranged around a center of the light receiving surface.

3. The light scanning unit of claim 1, wherein the at least two output terminals are spaced apart from each other in a direction perpendicular to the main scanning direction by a distance that is greater than a diameter of a beam spot of the received second portion of the light beam that is formed on the light receiving surface.

4. The light scanning unit of claim 3, wherein the distance between the at least two output terminals is at least 3.0 mm.

5. The light scanning unit of claim 1, wherein a rectangular opening portion having a lengthwise direction that is perpendicular to the scanning path of the received second portion of the light beam is formed in the light receiving surface of the beam detection sensor, the rectangular opening portion being disposed between the at least two output terminals.

6. The light scanning unit of claim 1, wherein the beam detection sensor is a pin photodiode, the at least two output terminals being a cathode terminal and an anode terminal, respectively.

7. The light scanning unit of claim 1, further comprising a beam detection lens being disposed between the beam detection mirror and the beam detection sensor, and being configured to focus the second portion of the light beam on the light receiving surface of the beam detection sensor.

8. An electrophotographic image forming apparatus, comprising:

a photosensitive body;

a light scanning unit configured to scan light onto a scanning surface of the photosensitive body to form thereon an electrostatic latent image; and a developing unit configured to supply toner to the electrostatic latent image formed on the photosensitive body to develop the electrostatic latent image into a visible toner image, wherein the light scanning unit comprises:

a light source configured to emit a light beam;

a beam deflector configured to deflect and to scan the light beam emitted from the light source along a main scanning direction;

a scanning optical system configured to receive a first portion of the light beam that is deflected and scanned by the beam deflector to form an image on a scanning surface with the received first portion of the light beam;

a beam detection mirror disposed between the beam deflector and the scanning optical system, to change a direction of an optical path of a second portion of the light beam toward the beam detection sensor; and a beam detection sensor configured to receive the second portion of the light beam that is deflected and scanned by the beam deflector and, without passing through the scanning optical system, to generate a synchronization signal based on the received second portion of the light beam, the synchronization signal being generated by photoelectrically converting the light beam incident on the light incident surface area and outputting the synchronization signal via at least two output terminals, wherein the beam detection sensor includes a light receiving surface upon which the second portion of the light beam is incident and the at least two output terminals that are arranged outside a scanning path of the received second portion of the light beam on the light receiving surface, and wherein the at least two output terminals are spaced apart from each other by a predetermined distance on the light receiving surface that is greater than the scanning path of the received second portion of the light beam between the at least two output terminals.

9. The electrophotographic image forming apparatus of claim 8, wherein the at least two output terminals are point-symmetrically arranged around a center of the light receiving surface.

10. The electrophotographic image forming apparatus of claim 8, wherein the at least two output terminals are spaced apart from each other in a direction perpendicular to the main scanning direction by a distance that is greater than a diameter of a beam spot of the received second portion of the light beam that is formed on the light receiving surface.

11. The electrophotographic image forming apparatus of claim 10, wherein the distance between the at least two output terminals is at least 3.0 mm.

12. The electrophotographic image forming apparatus of claim 8, wherein a rectangular opening portion having a lengthwise direction that is perpendicular to the scanning path of the received second portion of the light beam is formed in the light receiving surface of the beam detection sensor, the rectangular opening portion being disposed between the at least two output terminals.

13. The electrophotographic image forming apparatus of claim 8, wherein the beam detection sensor is a pin photodiode, the at least two output terminals being a cathode terminal and an anode terminal, respectively.

14. The electrophotographic image forming apparatus of claim 8, further comprising a beam detection lens, the beam detection lens being disposed between the beam detection mirror and the beam detection sensor, and being configured to focus the second portion of the light beam on the light receiving surface of the beam detection sensor.

* * * * *